US009670734B2

(12) United States Patent
Surjaatmadja et al.

(10) Patent No.: US 9,670,734 B2
(45) Date of Patent: Jun. 6, 2017

(54) REMOVAL OF CASING SLATS BY CUTTING CASING COLLARS

(71) Applicant: Halliburton Energy Services, Inc., Houston, TX (US)

(72) Inventors: Jim B. Surjaatmadja, Duncan, OK (US); Leldon Mark Farabee, Katy, TX (US); Jorn Tore Giskemo, Tananger (NO)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 310 days.

(21) Appl. No.: 14/504,468

(22) Filed: Oct. 2, 2014

(65) Prior Publication Data

US 2015/0144340 A1 May 28, 2015

Related U.S. Application Data

(63) Continuation of application No. 14/390,035, filed as application No. PCT/US2013/072123 on Nov. 27, 2013.

(51) Int. Cl.

| | |
|---|---|
| ***E21B 7/18*** | (2006.01) |
| ***E21B 33/13*** | (2006.01) |
| ***E21B 29/00*** | (2006.01) |

(52) U.S. Cl.

CPC ..... *E21B 7/18* (2013.01); *E21B 29/00* (2013.01); *E21B 29/005* (2013.01); *E21B 33/13* (2013.01)

(58) Field of Classification Search

CPC ..... E21B 7/18; E21B 33/13; E21B 29/005; E21B 29/00

See application file for complete search history.

(56) References Cited

U.S. PATENT DOCUMENTS

| | | | |
|---|---|---|---|
| 4,346,761 | A | 8/1982 | Skinner |
| 5,381,631 | A | 1/1995 | Raghavan et al. |
| 5,765,642 | A | 6/1998 | Surjaatmadja |
| 6,155,343 | A | 12/2000 | Nazzal et al. |
| 7,445,045 | B2 | 11/2008 | East, Jr. |
| 7,540,327 | B2 | 6/2009 | Billingham |
| 2005/0263282 | A1 | 12/2005 | Jeffrey et al. |
| 2005/0269099 | A1 | 12/2005 | Stegent |
| 2007/0251692 | A1 | 11/2007 | Billingham |

(Continued)

FOREIGN PATENT DOCUMENTS

| | | | | |
|---|---|---|---|---|
| DE | WO 2011148315 | A2 * | 12/2011 | ..... E21B 29/002 |
| WO | 2015080714 | A1 | 6/2015 | |

OTHER PUBLICATIONS

International Search Report and Written Opinion for PCT/US2013/072123 dated Aug. 22, 2014.

*Primary Examiner* — Michael Wills, III

(74) *Attorney, Agent, or Firm* — McDermott Will & Emery LLP

(57) ABSTRACT

Embodiments herein include a casing cutting tool comprising a top mandrel operatively coupled to a conveyance; a first retractable wedge operatively coupled to the top mandrel; a jetting tool operatively coupled to the retractable wedge, the retractable wedge thereby interposing the top mandrel and the jetting tool, wherein the jetting tool has one or more jetting nozzles arranged thereon; and a bottom terminal operatively coupled to the jetting tool, the jetting tool thereby interposing the retractable wedge and the bottom terminal.

17 Claims, 3 Drawing Sheets

(56) References Cited

U.S. PATENT DOCUMENTS

| | | | | |
|---|---|---|---|---|
| 2008/0236830 | A1 | 10/2008 | Fuhst et al. | |
| 2013/0199785 | A1* | 8/2013 | Hekelaar | E21B 29/005 166/298 |
| 2014/0231087 | A1* | 8/2014 | Orstad | E21B 31/16 166/298 |
| 2014/0352964 | A1 | 12/2014 | Surjaatmadja | |

* cited by examiner

REMOVAL OF CASING SLATS BY CUTTING CASING COLLARS

This application is a continuation of U.S. patent application Ser. No. 14/390,035 by Jim B. Surjaatmadja, filed on Oct. 2, 2014, entitled "Removal of Casing Slats by Cutting Casing Collars, which is a national stage application of PCT/US2013/72123 by Jim B. Surjaatmadja, filed on Nov. 27, 2013, entitled "Removal of Casing Slats by Cutting Casing Collars."

BACKGROUND

The present disclosure relates to systems and methods of plugging a wellbore for abandonment and, more particularly, to using a casing cutting tool having a jetting tool with fluid jet nozzles and a retractable wedge for removing wellbore casing in preparation for the placement of a cement plug.

In the oil and gas industry, once a hydrocarbon bearing well reaches the end of its useful life, the well is decommissioned for abandonment. Regulations under various state and federal laws require decommissioned wells to be properly plugged and sealed using "plug and abandonment" procedures before abandoning the well. Plug and abandonment operations performed in a cased wellbore require that certain portions of the wellbore be filled with cement to prevent the upward movement of fluids toward the surface of the well. To seal the wellbore, a bridge plug is typically placed at a predetermined depth within the wellbore and cement is then introduced to form a column of cement high enough to ensure that the wellbore is permanently plugged.

In addition to simply sealing the interior of the wellbore, state and federal regulations also often require that an area outside of the wellbore be sufficiently blocked to prevent any fluids from migrating towards the surface of the well along the outside of the casing string. For example, in well completions having one or more strings of casing lining the wellbore, the annular area between the strings can form a fluid path even though they had been cemented into place when the well was initially completed. The combination of poor cement sealing and/or weakening conditions of cement over time may additionally lead to fluid paths opening in the cement that could allow for the passage of fluid to the surface.

In order to ensure the area outside of the wellbore is adequately blocked, cement is typically injected or "squeezed" through perforations in the casing and into the formation surrounding the wellbore. By pumping cement in a non-circulating system, a predetermined amount of cement may be forced into the surrounding formation and can thereafter cure to form a fluid barrier. In cases where the wellbore to be plugged and abandoned has an outer string of casing and an inner string of casing coaxially disposed therein, the annular space between the concentric strings must also be squeezed with cement to prevent the subsequent migration of fluid towards the surface of the well.

The cement squeeze approach, however, does not guarantee that the cement fully contacts the surrounding formation because the cement is typically required to pass through a narrow passage that may or may not allow the cement to reach all areas of the surrounding formation. Accidental over-pressurization may also create a fracture, which may result in a failed plugging operation. As a result, the plug job may be compromised or rendered at least partially ineffective. Another approach that exposes the surrounding rock formation is reaming out the wellbore over the desired area.

Reaming, however, is quite time consuming and costly and therefore not a viable alternative in some wells.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
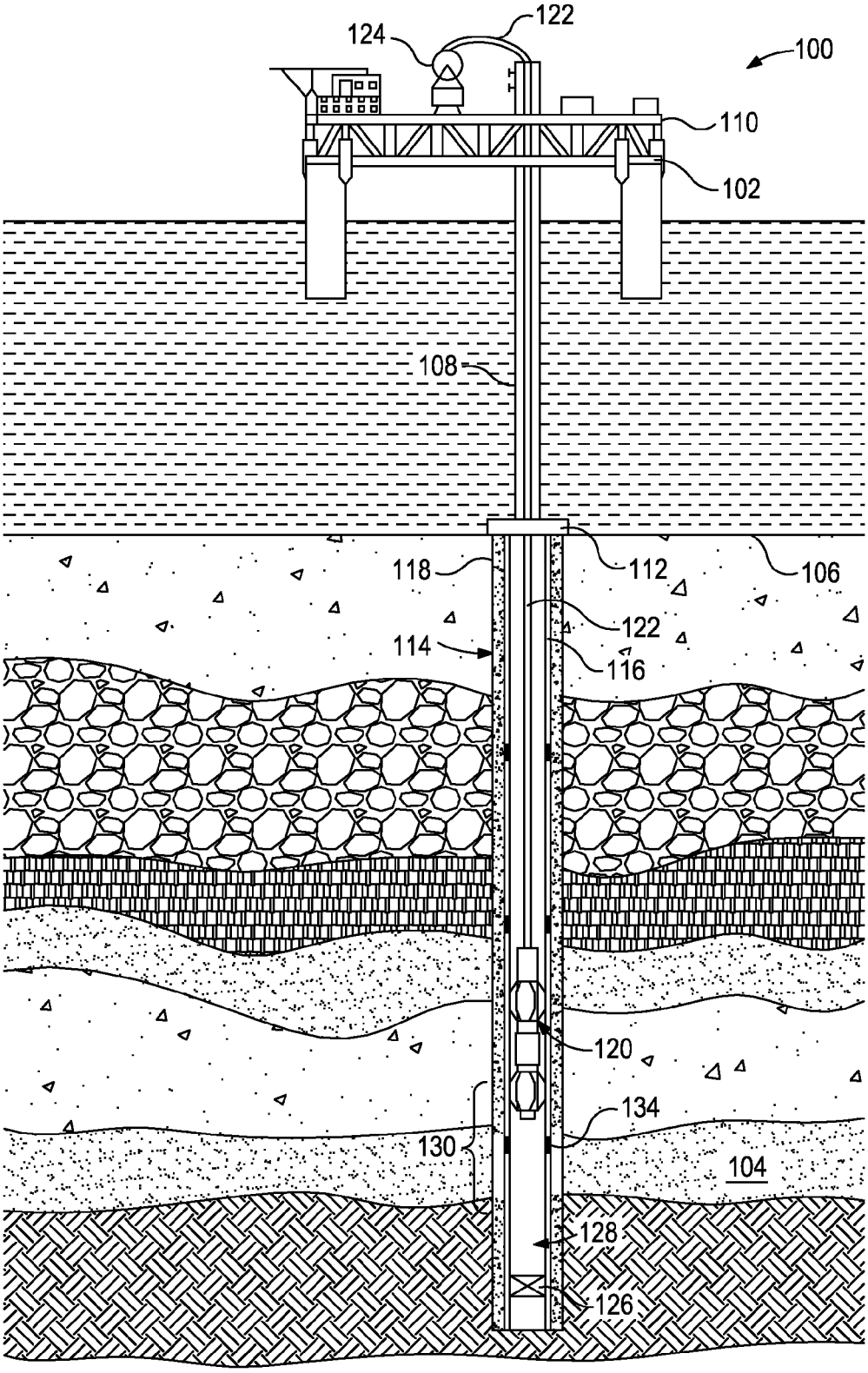
FIG. 1 is an offshore oil and gas rig that may employ one or more principles of the present disclosure, according to one or more embodiments.

The present disclosure relates to systems and methods of plugging a wellbore for abandonment and, more particularly, to using a casing cutting tool having a jetting tool with fluid jet nozzles and a retractable wedge for removing wellbore casing in preparation for the placement of a cement plug.

Disclosed herein are systems and methods used to decommission wellbores in compliance with laws and regulations for abandonment purposes. According to the present disclosure, a casing cutting tool may be introduced into a wellbore and configured to excise a portion of the casing and/or cement to expose the subterranean formation. Specifically, the casing cutting tool may be introduced into a wellbore and configured to excise a portion of the casing and/or cement between two or more casing collars to expose the subterranean formation. By cutting the casing collars, they are no longer able to hold in place the portion of the casing string and the corresponding cement, allowing for the casing section between the casing collars to be easily removed.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The casing cutting tool may excise the casing and/or cement using one or more jetting nozzles arranged thereon. The nozzles may be configured to eject a fluid, which may comprise as an abrasive cutting solution, capable of cutting into and through one or more casing strings and any accompanying cement bonds disposed in the wellbore. The casing cutting tool may make primarily longitudinal cuts and may comprise one or more retractable wedges capable of guiding the casing cutting tool in the longitudinal cuts, thereby preventing or reducing any movement of the casing cutting tool as cuts are made. The casing cutting tool may additionally make radial cuts in combination with the longitudinal cuts. The cuts made by the casing cutting tool into and through one or more casing stings and cement bonds may remove sections of the casing string and cement bonds so as to expose the subterranean formation in a wellbore. In some embodiments, the casing cutting tool may additionally remove portions of the subterranean formation itself. By removing the casing and cement all the way to the subterranean formation (e.g., the rock face), a cement plug may then be placed at that location in direct contact with the formation and thereby permanently seal the wellbore for abandonment. As will be appreciated, such systems and methods may prove advantageous in replacing costly and time-consuming reaming processes currently used in wellbore abandonment operations.

Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Referring to FIG. 1, illustrated is an offshore oil and gas rig 100 that may employ one or more principles of the present disclosure, according to one or more embodiments. Even though FIG. 1 generally depicts an offshore oil and gas rig 100, those skilled in the art will readily recognize that the various embodiments disclosed and discussed herein are equally well suited for use in or on other types of service rigs, such as land-based rigs or rigs located at any other geographical site.

As illustrated, the rig 100 may encompass a semi-submersible platform 102 centered over one more submerged oil and gas formations 104 located below the sea floor 106. A subsea conduit 108 or riser extends from the deck 110 of the platform 102 to a wellhead installation 112 arranged at or near the sea floor 106. As depicted, a wellbore 114 extends from the sea floor 106 and has been drilled through various earth strata, including various submerged oil and gas formations 104. A casing string 116 is at least partially cemented within the wellbore 114 with cement 118. The term "casing" is used herein to designate a tubular string used to line the wellbore 114. The casing may be of the type known to those skilled in the art as a "liner" and may be segmented. These segments may be connected via casing collars 134. As used herein, the term "casing collar" or "collar" refers to a treaded connector used to connect two joints or segments of casing.

During the viable life of the well, hydrocarbons may be extracted from the submerged oil and gas formations 104 and produced to the rig 100 via the wellbore 114 and the subsea conduit 108 for processing. Once the available hydrocarbons in the formations 104 are depleted or it is otherwise economically impracticable to maintain the well, a well operator may decide to decommission the well. Decommissioning the well may entail preparing and plugging the wellbore 114 such that unwanted subterranean fluids are prevented from escaping into the surrounding environment. After the well is properly plugged, the well operator may abandon the wellbore 114. This well decommissioning undertaking is often referred to as a "plug and abandon" operation.

According to the embodiments herein, the wellbore 114 may be prepared for plugging and abandonment using a casing cutting tool 120 that is introduced into the wellbore 114 from the rig 100. The casing cutting tool 120 may be run into the wellbore 114 on a conveyance 122, which may be fed into the wellbore 114 from a reel 124 arranged on the deck 110 of platform 102. In some embodiments, the conveyance 122 may be a flexible conduit, such as coiled tubing or the like. In other embodiments, the conveyance 122 may be any rigid or semi-rigid conduit capable of conveying the casing cutting tool 120 into the wellbore 114. In at least one embodiment, the conveyance 122 may be drill pipe or another type of rigid tubular and, in such embodiments, the reel 124 may be replaced by other means, such as by a workover (or servicing) rig that may be purely mechanical or hydraulic.

As part of the preparation process for plugging and abandoning the wellbore 114, a bridge plug 126 may be set within the wellbore 114 below the casing cutting tool 120 to seal the lower portion of the wellbore 114. In some cases, the bridge plug 126 may be pre-placed in the wellbore 114 prior to running the casing cutting tool 120 into the wellbore 114. In other embodiments, the casing cutting tool 120 may help facilitate the placement and setting of the bridge plug 126. The borehole area above the bridge plug 126 and below the area of the wellbore 114 to be prepared for plug and abandonment may be referred to as a "rathole" 128, and may be suitable for the accumulation of debris and casing cuttings generating by the casing cutting tool 120.

As will be described in greater detail below, the casing cutting tool 120 may be configured to strategically excise portions of the casing string 116 and cement 118, over a predetermined section or length 130 of the wellbore 114. The excised portion of the casing string 116 and cement 118 may fall into the rathole 128, thus exposing face of formation 104 for subsequent placement of a cement plug (not shown). Advantageously, by falling into the rathole 128, the excised portions of the casing string 116 and the cement 118 are also removed from the area of the wellbore 114 that is to be plugged, thereby not presenting an obstruction to the subsequent cementing operation.

The axial length 130 of the wellbore 114 to be treated or otherwise cut with the casing cutting tool 120 may be any length required to properly plug and seal the wellbore 114 with a cement plug. In some embodiments, for example, the axial length 130 of the wellbore 114 to be treated may range from about 30 feet to about 150 feet, and any length therebetween. Those skilled in the art will readily recognize that the axial length 130 of wellbore 114 to be treated or otherwise cut may be less than 30 feet or more than 150 feet, without departing from the scope of the disclosure. In some cases, for example, a minimum or predetermined axial length 130 may be required or otherwise prescribed by local wellbore decommissioning laws and/or regulations.

Figure 2:
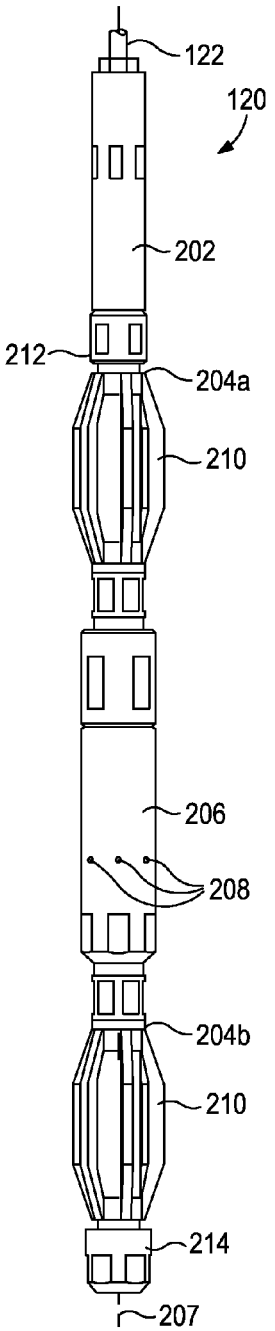
FIG. 2 illustrates and exemplary casing cutting tool, according to one or more embodiments of the present disclosure.

Referring now to FIG. 2, with continued reference to FIG. 1, illustrated is an exemplary casing cutting tool 120, according to one or more embodiments. As illustrated, the casing cutting tool 120 may at least include, arranged along the longitudinal axis 207 of the casing cutting tool 120, a top mandrel 202, one or more retractable wedges 204, illustrated as upper retractable wedge **204*a* and lower retractable wedge 204*b*, a jetting tool 206 having jetting nozzles 208, and a bottom terminal 212. While the casing cutting tool 120 is depicted in FIG. 2 as having a particular design and structural configuration, those skilled in the art will readily recognize that many variations to the design, configuration, and components of the casing cutting tool 120 may equally be used without departing from the scope of the disclosure. For example, the casing cutting tool 120 may have only a single retractable wedge 204 located either below or above jetting tool 206 along longitudinal axis 207 or greater than two retractable wedges 204 may be included in the casing cutting tool 120 at any point along longitudinal axis 207. Additionally, the structural arrangement of the top mandrel 202, the retractable wedge(s) 204, and the jetting tool 206 along longitudinal axis 207 of the casing cutting tool 120** may vary, depending on the application.

In the illustrated embodiment, the top mandrel 202 may be operatively coupled to the conveyance 122 by any means known in the art. An upper retractable wedge 204*a* may interpose the top mandrel 202 and the jetting tool 206. A lower retractable wedge 204*b* may be operatively coupled to the jetting tool 206 and the bottom terminal 212. As used herein, the term "operatively coupled" refers to a physical connection between two or more components. The term "operatively coupled" does not imply any particular type of connection or strength of connection therebetween.

The retractable wedge 204 may be configured as a guide tool having a plurality of detents 210 that may enter into the grooves formed from the cuts made by the casing cutting tool 120. The detents 210 may be spring-loaded, pressure actuated, or otherwise retractable such that, in some embodiments, the detents 210 may enter into the grooves when desired by the wellbore operator and, in other embodiments, the detents 210 may retract and become substantially the same diameter or less than the jetting tool 206. The retractable wedge 204 may additionally serve as a centralizer to maintain the jetting tool 206 at a predetermined or known distance from the inner wall of the casing string 116 during operation.

In exemplary embodiments, the retractable wedge 204 (e.g., the upper retractable wedge 204*a* and the lower retractable wedge 204*b*) may have the same number of detents 210 as the jetting nozzles 208 on jetting tool 206 and may be identically spaced apart as compared to the jetting nozzles 208, such that the detents 210 align with the cuts made by the casing cutting tool 120 as it is moved along the axial length 130 of the wellbore 114. In some embodiments, the retractable wedge 204 may have between two and eight detents 210. A portion or all of the detents included in retractable wedge 204 may engage the cut grooves formed by the casing cutting tool.

By placing the detents 210 of the retractable wedge 204 into the cut grooves, the retractable wedge 204 may prove advantageous in preventing the casing cutting tool 120 from rotating within the wellbore 114 about the longitudinal axis 207 as the casing cutting tool 120 cuts, thereby generally maintaining the jetting nozzles 208 on the jetting tool 206 at a particular location relative to the axial length 130 of wellbore 114 such that substantially straight longitudinal grooves may be cut therein. In some embodiments, as depicted, the ability of the retractable wedge 204 to prevent rotation of the casing cutting tool 120 may be aided by a swivel head 214 interposing top mandrel 202 and retractable wedge 204. The swivel head 214 may reduce the torque that may be experienced by the casing cutting tool 120 by preventing conveyance 122 from rotating during cutting.

As previously mentioned, the jetting tool 206 may have one or more jetting nozzles 208 (three shown) arranged thereon and at least partially exposed about the circumference of the jetting tool 206. In some embodiments, the jetting nozzles 208 may be equidistantly spaced from each other about the circumference of the jetting tool 206. In other embodiments, however, one or more of the jetting nozzles 208 may be randomly spaced from each other about the circumference of the jetting tool 206, without departing from the scope of the disclosure.

In some embodiments, as illustrated, the jetting nozzles 208 may be arranged about the circumference of the jetting tool 206 is a single axial plane along the length of the jetting tool 206. In other embodiments, however, one or more of the jetting nozzles 208 may be axially offset from one or more other jetting nozzles 208 along the longitudinal axis 207 of casing cutting tool 120. In at least on embodiment, for example, the jetting nozzles 208 may be arranged about the circumference of the jetting tool 206 in a generally helical arrangement such that each jetting nozzle 208 is at least one of axially and radially offset from the other jetting nozzles 208. In exemplary embodiments, the jetting nozzles 208 are aligned such that one or more of the detents 210 on the retractable wedge 204 may enter into the grooves cut by the casing cutting tool 120. Those skilled in the art will readily appreciate that different arrangements or configurations of the jetting nozzles 208 in the jetting tool 206 may be employed without departing from the scope of the disclosure.

While only three jetting nozzles 208 are depicted in FIG. 2, it will be appreciated that more or less than three jetting nozzles 208 may be used in the jetting tool 206 without departing from the scope of the disclosure. The number of jetting nozzles 208 required or desired may depend on the structural parameters of the wellbore 114 in which the casing cutting tool 120 is to be used. For example, the required number of jetting nozzles 208 may vary depending on the thickness of the casing string 116, whether the casing string 116 comprising two or more concentrically disposed casing strings, the thickness of the cement 118 surrounding the casing string(s) 116, and other wellbore 114 parameters known to those skilled in the art.

The jetting nozzles 208 may be fluid nozzles or hydrajet nozzles configured to receive and eject a fluid at an elevated pressure and velocity toward the inner wall of the wellbore 114. The fluid ejected from the nozzles 208 may be configured to cut into and through the casing string 116 and the surrounding cement 118 (FIG. 1) over the predetermined axial length 130 of the wellbore 114. The conveyance 122 may be configured to provide the casing cutting tool 120 and the jetting nozzles 208 with the fluid with which to cut the wellbore 114. The casing cutting tool 120 and the conveyance 122 may be designed to operate at extreme downhole conditions, including operating at elevated temperatures, pressures, within corrosive environments, and the like.

The fluid used in the casing cutting tool 120 for cutting the wellbore 114 using jetting nozzles 208 may be any fluid known to those skilled in the art that is able to cut through materials commonly found in wellbores, such as steel, cement, and the formation itself. In some embodiments, the fluid may be any aqueous fluid including fresh water, saltwater (e.g., water containing one or more salts dissolved therein), brine (e.g., saturated salt water), seawater, and any combination thereof. In other embodiments, the fluid may further include an abrasive cutting agent. The abrasive cutting agent may be include, but is not limited to, sand (fine or coarse), bauxite, garnets, ash, semi-water soluble materials (e.g., borax, colemanite, and the like), and any combination thereof. In some embodiments, the abrasive cutting agent may be a chemical, such as a halogen fluoride. In other embodiments, the fluid may comprise a surfactant, an acid, a base, and any combination thereof.

In some embodiments, the bottom terminal 212 may be configured as an open conduit, such that conveyance 122 or any other line may be run through the casing cutting tool 120 along the entire longitudinal axis 207. In some embodiments, bottom terminal 212 may be plugged with a removable nipple, such as a bell nipple). In exemplary embodiments, the removable nipple may be removed so as to allow a camera mounted on a line to retract through the bottom terminal 212 when the nipple is removed and return into the bottom terminal 212 when the nipple is put back in place. The camera may be used to inspect the surrounding wellbore 114 after a cutting operation (e.g., to locate casing collars 134 (FIG. 1) that were not removed and require cutting or additional cutting) and communicate the information to a well operator who may then position casing cutting tool 120 at a desired location within the wellbore 114. The removable nipple may be replaced when the camera is no longer needed. In other embodiments, the bottom terminal 212 may be configured as a cone guide, such that the cone guide tapers toward the lower portion of casing cutting tool 120 (i.e., toward the portion of the casing cutting tool 120 that is deepest in the wellbore 114). The bottom terminal 212 configured as a cone guide may be beneficial when the casing cutting tool 120 must pass portions of the wellbore 114 that have already been cut and that may collapse at least partially into the wellbore 114. The bottom terminal 212 may also be configured to fish the casing cuttings from the wellbore 114, such as being configured with a strong electromagnet. As used herein, the term "fish" refers to the removal of any unwanted item(s) (e.g., casing cuttings) from the wellbore.

In some embodiments, the casing cutting tool 120 may have located anywhere thereon one or more casing collar locators (not shown) capable of locating casing collars 134 to be cut (FIG. 1). The casing collar locator may be located on the bottom terminal 212, on the jetting tool 206, on any one or more of the retractable wedges 206, or on the top mandrel 202 of casing cutting tool 120, such that the a well operator may locate casing collars 134 and define the position of the casing cutting tool 120 relative to such casing collars 134. The casing collar locator may be any two-way telemetry device capable of transmitting the location of casing collars 134 to the surface of the wellbore 114, such as on platform 102, for detection by a detection device (not shown).

The casing collar locator may operate to identify the casing collars 134 alone or in combination with a stimulus placed on the casing collars 134 themselves or emanating therefrom. In some embodiments, the casing collar locator may be capable of detecting metal thickness or metal amount to locate the casing collars 134 because the metal thickness and amount will be greater at the casing collars 134 than at other portions of the casing string 116. In other embodiments, the casing collar locator may be an acoustic sensor encompassing an acoustic wave microphone capable of picking up the unique acoustic signature of the casing collars 134 in the wellbore 114. In some embodiments, the casing collar locator may be a magnetic sensor (e.g., a microelectromechanical system (MEMS), an electromagnetic sensor, a rare earth metal sensor, and the like) capable of detecting magnets placed on the surface of the casing collars 134 or otherwise associated therewith. The casing collar locator may, in some embodiments, may be a radio frequency (RF) sensor capable of picking up a radio frequency identification tag (RFID) secured to or otherwise forming part of the casing collars 134. In other embodiments, the casing collar locator may be a mechanical casing collar locator capable of detecting gaps where a casing collar 134 connects two casing strings 116 (i.e., a gap is formed between the two casing strings 116 where the casing collar 134 connects them), which may be particularly useful in older wells.

The casing collar locator may be capable of transmitting a signal to a detection device located at the surface (e.g., on platform 102). The detection device may be communicably coupled to the casing collar locator via one or more communication lines. The communication lines may be any wired or wireless means of telecommunication between two locations and may include, but are not limited to, electrical lines, fiber optic lines, radio frequency transmission, electromagnetic telemetry, acoustic telemetry, or any other type of telecommunication means known to those skilled in the art.

In at least one embodiment, the detection device may be a computer system configured to receive the signal sent through the communication line(s) from the casing collar locator. A well operator may then be able to consult the computer system and thereby become apprised of the location of one or more casing collars 134 in the wellbore 114. In some embodiments, the computer system may include one or more peripheral devices associated therewith (e.g., a monitor, a print out from a printer, an audible alarm, a visual alarm, and the like) that are configured to alert the well operator of the location of the casing collars 134 in the wellbore 114. In another embodiment, the detection device may be a surface detector capable of sensing the acoustic sound generated by the mechanical casing collar locator (e.g. mechanical clicks).

Figure 3:
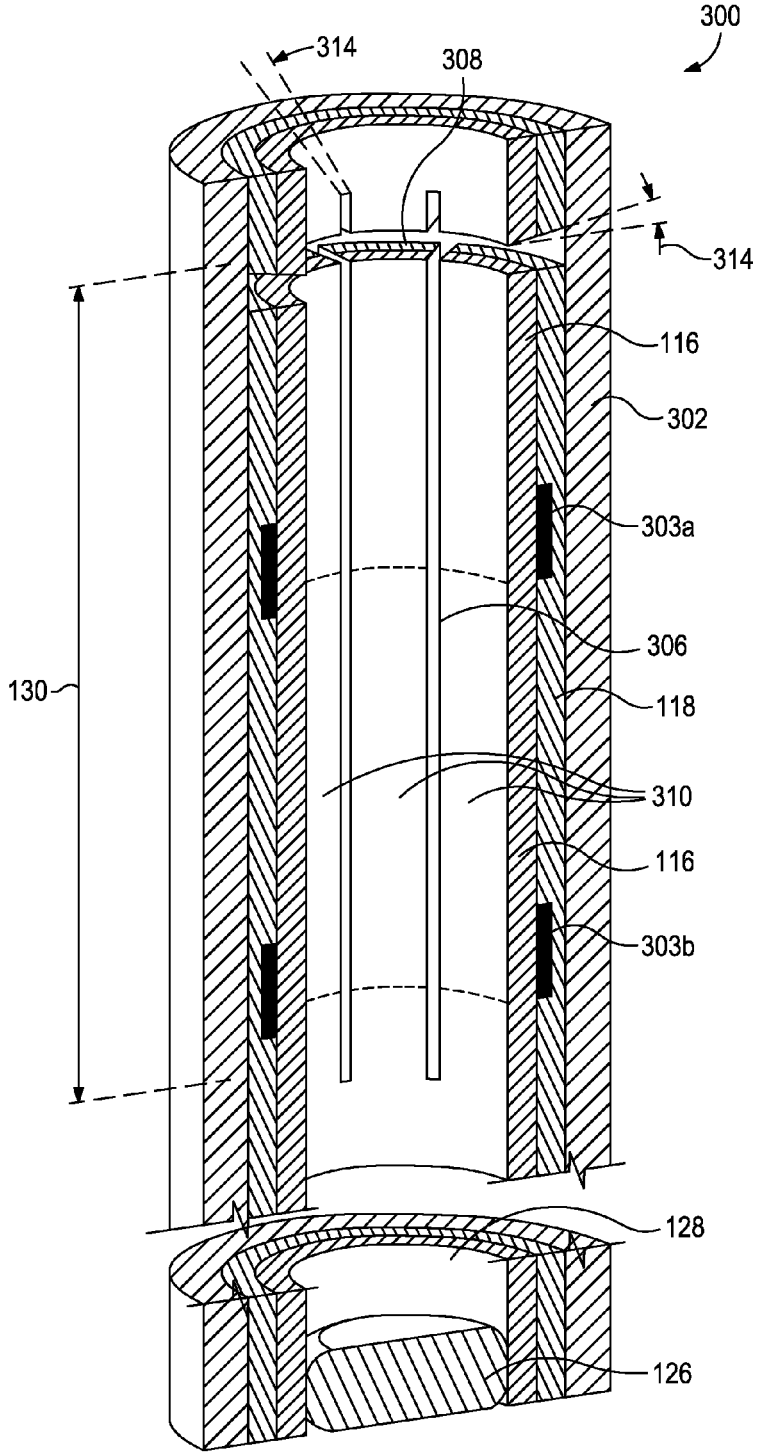
FIG. 3 illustrates a cross-sectional view of a portion of an exemplary wellbore that has been treated or cut using the exemplary casing cutting tool of FIG. 2, according to one or more embodiments of the present disclosure.

Referring now to FIG. 3, with continued reference to FIG. 1 and FIG. 2, illustrated is a cross-sectional view of a portion of an exemplary wellbore 300 that has been treated or otherwise cut using the exemplary casing cutting tool 120 illustrated in FIG. 2. The wellbore 300 may be similar in one or more respects to the wellbore 114 illustrated in FIG. 1 and therefore may be best understood with reference thereto, where like numerals will represent like elements or components. As illustrated, the wellbore 300 may be defined or otherwise drilled into formation rock 302 that forms part of the one or more subterranean formations 104 (FIG. 1). The wellbore 300 may be lined with casing strings 116 separated by casing collars 303, illustrated as upper casing collar **303*a* and lower casing collar 303*b*. While a single longitudinal series of casing strings 116 are depicted in FIG. 3, those skilled in the art will readily appreciate that more than longitudinal series of casing strings 116 may concentrically line the wellbore 300**, without departing from the scope of the disclosure.

In the illustrated embodiment, cement 118 may be disposed between the casing strings 116 and the formation rock 302. A bridge plug 126 may be installed or otherwise set within the wellbore 300 at a distance below the area of the wellbore 300 defined in the wellbore 300 above the bridge plug 126 and generally below the area of the wellbore 300 that is to be treated or otherwise cut with the casing cutting tool 120.

As illustrated, the casing cutting tool 120 has made a plurality of longitudinal cuts 306 in the wellbore 300 encompassing the predetermined axial length 130 of the wellbore 300. In some embodiments, the casing cutting tool may also make one or more transverse cuts 308 in the wellbore 300. The longitudinal cuts 306 (and if made, the transverse cuts 308) generate corresponding groves in the wellbore 300 that define a plurality of removable pieces, portions, slats, chunks, or wedges. To make the longitudinal cuts 306, the casing cutting tool 120 may be slowly moved or "stroked" up or down axially within the wellbore 300 over the axial length 130. To accomplish this, the conveyance 122, as operated from the platform 102 (FIG. 1), may manipulate and regulate the axial position and speed of the casing cutting tool 120 during operation. As the casing cutting tool 120 moves within the wellbore 300, the jetting nozzles 208 (FIG. 2) continuously eject fluid that cuts through the casing strings 116 and the cement 118. In some embodiments, the casing cutting tool 120 may be stroked within the wellbore 300 multiple times in order to penetrate the casing strings 116 and the cement 118 until reaching or otherwise exposing the formation rock 302.

In some embodiments, the casing cutting tool 120 may begin cutting (i.e., ejecting fluid through the jetting nozzles 208) at lower casing collar 303*b* and continue cutting until reaching upper casing collar 303*a* so as to remove the casing string 116 and cement 118 comprising the area between lower casing collar 303*b* and upper casing collar 303*a* until reaching or otherwise exposing the formation rock 302. In other embodiments, the casing cutting tool 120 may begin cutting at upper casing collar 303*a* and continue cutting until reaching lower casing collar 303*b* so as to remove the casing string 116 and cement 118 comprising the area between upper casing collar 303*a* and lower casing collar 303*b*. The casing cutting tool 120 may make a single stroke (or pass) or may be stroked up and down (or down and up) axially within the wellbore 300 between upper casing collar 303*a* and lower casing collar 303*b* so as to remove a portion of the casing string 116. By cutting through the casing collars 303*a* and 303*b*, the section of casing string 116 and cement 118 spanning the distance between the collars may be exposed and allowed to fall into rat hole 128.

In some embodiments, the casing cutting tool 120 may be used to cut through two or more casing collars beginning at a lower casing collar and working upward an upper casing collar. In other embodiments, the casing cutting tool 120 may be used to cut through two or more casing collars beginning at an upper casing collar and working downwards to a lower casing collar. The casing may be removed in slats that fall into the rat hole 128 and past the casing cutting tool 120. The longitudinal cuts 306 and, in some cases, the transverse cuts 308 may be made in a single stroke or by stroking up and down (or down or up) the casing cutting tool 120 multiple times within the wellbore 300. As will be appreciated, the number of longitudinal cuts 306 may depend directly on the number of jetting nozzles 208 employed in the casing cutting tool 120. Alternatively, any number of longitudinal cuts 306 may be made using any number of jetting nozzles 208. The detents 210 of retractable wedge 204 (FIG. 2) may rest within the longitudinal cuts 306 to prevent or reduce rotation of the casing cutting tool 120 during cutting operations.

In some embodiments, one or more transverse cuts 308 may be made following the formation of the longitudinal cuts 306. To make the transverse cuts 308, the detents 210 of the retractable wedge 204 may be retracted and the casing cutting tool 120 may be rotated about its longitudinal axis 207 at predetermined locations or depths along the axial length 130. The conveyance 122, may be manipulated or regulated from the platform 102 (FIG. 1), and may serve to rotate the casing cutting tool 120 at a desired speed and/or over a predetermined time limit in order to properly form the transverse cuts 308. As the casing cutting tool 120 is rotated, the nozzles 208 (FIG. 2) continuously eject the fluid to cut through a portion of the casing string 116 and the cement 118 in an annular pattern. In some embodiments, the casing cutting tool 120 may be rotated about its longitudinal axis 207 multiple times in order to properly penetrate the casing string 116 and the cement 118 until reaching or otherwise exposing the formation rock 302.

In some embodiments, the transverse cuts 308 may be made starting at or near the bottom of the axial length 130, such as at lower casing collar 303*b*. Once the first transverse cut 308 is made at a first location, the conveyance 122 may move the casing cutting tool 120 axially in the uphole direction (e.g., towards the top of FIG. 3) a distance a second location, such as upper casing collar 303*a*, or at any location or casing collar therebetween. The distance between axially adjacent transverse cuts 308 (i.e., between the first and second locations) may vary, depending on the application. In some embodiments, for example, the distance between axially adjacent transverse cuts 308 may be about six inches. In other embodiments, however, the distance between axially adjacent transverse cuts 308 may be about one foot, about two feet, about five feet, any distance therebetween, or greater than five feet. Moreover, in some embodiments, the distance between two or more casing collars 303 may dictate the distance between axially adjacent transverse cuts. After forming the transverse cut 308 at the second location, the casing cutting tool 120 may be again moved in the uphole direction to a third location. This process may be repeated until multiple transverse cuts 308 are formed along the predetermined axial length 130 of the wellbore 114.

The longitudinal cuts 306 serve to define slats 310 in the wellbore 300 and when used in combination with transverse cuts 308, the slats may be cut to certain sizes, which may facilitate removal of the slats 310. In exemplary embodiments, the slats 310 are made between two casing collars, such as between lower casing collar 303*b* and upper casing collar 303*a*. In some embodiments, the slats may be formed over the length of multiple casing collars 303 in the wellbore 114. The fluid pressure of the jetting nozzles 208 (FIG. 2) may pressurize the area behind each slat 310, thereby causing the slats 310 (e.g., the casing string 116 and the cement 118 between lower casing collar 303*b* and upper casing collar 303*a*) to dislodge from the formation rock 302 and drop into the rathole 128 therebelow. That is, as the jetting nozzles 208 ejects fluid at a pressure such that it impinges upon, impacts, or otherwise erodes the backside of each slat 310, the slats 310 may dislodge and be extricated from the formation rock 302, thereby allowing the loosened slats 310 to fall into the rathole 128.

As will be appreciated by one of skill in the art, however, since the wellbore 300 is round, the longitudinal cuts 306 and, optionally, the transverse cuts 308 made into the wellbore 300 will radially extend into the wellbore 300 such that the outer radial dimension of each cut 306, 308 will be greater than its corresponding inner radial dimension. This means, theoretically, that if the cuts 306, 308 were narrow cuts, such as being cut by a thin knife, or the like, then the slats 310 would be prevented from being excised or extricated because of their resulting larger outer radial dimensions.

According to the present disclosure, however, the jet generated by each jetting nozzle 208 may naturally "flare out" or otherwise create a correspondingly wider cut in the wellbore 300 as the jet extends deeper into the wellbore 300 in the radial direction. In some embodiments, the jet may be configured to flare out even more by using high viscosity fluids. As a result, each resulting cut 306, 308 may be wider at its outer radial dimension than at its corresponding inner radial dimension. In some embodiments, for example, the jetting nozzles 208 may generate a jet that creates a cut that exhibits an angle 314 using either longitudinal cuts 306 or transverse cuts 308. The angle 314 of the cut 306, 308 may vary depending on the type of jetting nozzle 208, the fluid type, the pressure of the fluid, the velocity of the fluid, and other hydro-jetting parameters known to those skilled in the art. In at least one embodiment, the angle 314 of the cut generated by the jetting nozzles 208 may range between about 10° and about 20°, between about 12° and about 18°, or between about 15° and about 16°.

As the cuts 306, 308 extend deeper and deeper into the walls of the wellbore 300 (i.e., penetrating casing string(s) 116 and cement 118), sand, cement, and/or other debris may be loosened within the cuts 306, 308 and/or any additional cavities or abrasions formed within the wellbore 300 during a cutting operation. The violent swirling of the jet produced by each jetting nozzle 208, in conjunction with the sand, cement, and/or other debris, may proceed to erode the cavity walls, thereby generating a larger opening at the outer radial dimension of each cut 306, 308 than at its corresponding inner radial dimension. As a result, the slats 310 may be extricated from the formation rock 302 without having their corresponding outer radial dimension bind on its corresponding inner radial dimension. Consequently, during the cutting of the longitudinal cuts 306 (e.g., between casing collars 303) and optionally the transverse cuts 308, the bond caused by the cement 118 between the casing string 116 and the inner diameter of the formation rock 302 may be released such that the slats 310 are able to be dislodged from the formation rock 302 and fall into the rathole 128 therebelow.

Prior to introducing the casing cutting tool 120 into the wellbore 114, several parameters of the operation may be determined or otherwise measured. For example, a wellbore operator may first determine the required or desired axial length 130 of the wellbore 114 to be removed. Knowing the required axial length 130 may provide the operator with information as to the stroke length required by the conveyance 122 and also how many longitudinal cuts 306, and optional transverse cuts 308 (FIG. 3) will be needed. Other parameters of the operation that may be determined include, but are not limited to, the inner diameter of the casing string 116 ("$ID_c$"), the inner diameter of the open hole ("$ID_o$") (e.g., the approximate inner diameter of the formation rock 302), and the outer diameter of the jetting tool 206 ("$OD_{JT}$"). Using these measurements and determinations, the jetting distance to the casing string 116 from the jetting tool 206 "$D_i$" and the jetting distance to the formation rock 302 from the jetting tool 206 "$D_d$" may be determined using the following equations:

$$D_i = ID_c - OD_{JT} \quad \text{Equation (1)}$$

$$D_d = ID_o - OD_{JT} \quad \text{Equation (2)}$$

Knowing the jetting distance to the casing string 116 "$D_i$" and the jetting distance to the formation rock 302 "$D_d$" allows an operator to determine the size of the frontside of each cut "FC" and the size of the backside of each cut "BC" using the following equations:

$$FC = D_i * \tan(16°) + NS = 0.286 D_i + NS \quad \text{Equation (3)}$$

$$BC = D_d * \tan(16°) + NS = 0.286 D_d + NS \quad \text{Equation (4)}$$

where "NS" is the selected size of each jetting nozzle 208, and 16° is the assumed angle 314 (FIG. 3) of the cut made by the selected NS. The width of the frontside of the resulting cut "$C_F$" and the width of the backside of the resulting cut "$C_B$" may then be determined using the following equations:

$$C_F = \Pi * ID_c / N + 2 * FC \quad \text{Equation (5)}$$

$$C_B = \Pi * ID_o / N - BC \quad \text{Equation (6)}$$

where "N" is the number of jetting nozzles 208 used in the jetting tool 206. The number N of nozzles 208 in the jetting tool 206 may then be manipulated until the width of the frontside of the resulting cut $C_F$ becomes greater than the width of the backside of the resulting cut $C_B$. With the appropriate number N of jetting nozzles 208 known or otherwise determined, an operator can run the casing cutting tool 120 into the wellbore 114 with an appropriately configured jetting tool 206.

Figures 4A, 4B, 4C:
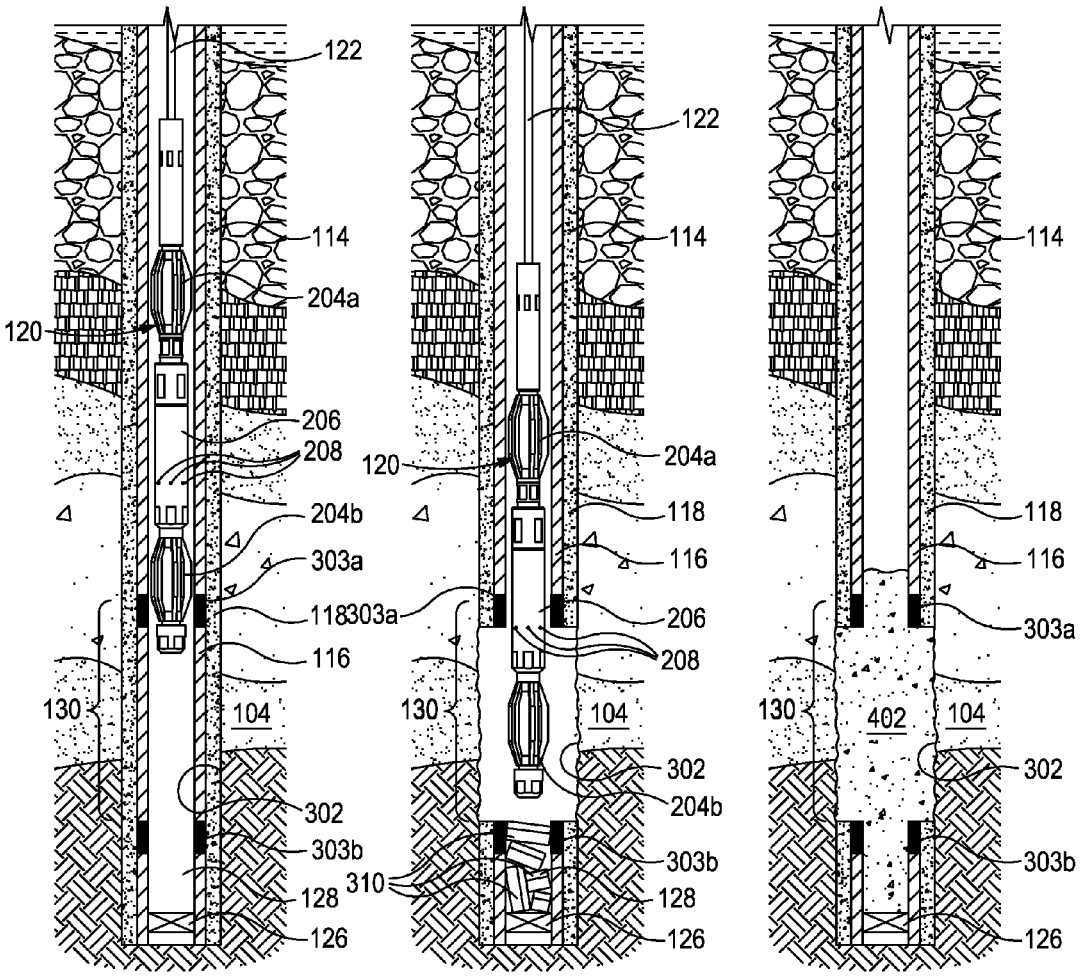
FIGS. 4A-4C illustrate progressing views of a wellbore over the span of an exemplary casing cutting operation, according to one or more embodiments of the present disclosure.

Referring now to FIGS. 4A-4C, with continued reference to the preceding figures (especially FIG. 1), illustrated are progressing views of the wellbore 114 of FIG. 1 over the span of an exemplary casing cutting operation, according to one or more embodiments. More particularly, FIG. 4A illustrates the casing cutting tool 120 as it is extended into the wellbore 114 to the target location where the wellbore 114 is to be prepared for a plugging and abandonment operation. As described above, the casing cutting tool 120 may be configured to excise or remove the casing string 116 and surrounding cement 118 along a predetermined axial length 130 of the wellbore 114, to thereby expose the underlying formation rock 302. In an exemplary embodiment, the casing cutting tool 120 may begin cutting longitudinal cuts 306 (FIG. 3) at lower casing collar 303*b* using jetting nozzles 208, whereby one or more retractable wedges 204 (FIG. 2), illustrated in FIG. 4A-B as lower retractable wedge 204*b* and upper retractable wedge 204*a* may insert into the longitudinal cuts 306 as the casing cutting tool 120 is guided up through the wellbore 114 toward upper casing collar 303*a* and prevent the casing cutting tool 120 from substantially rotating.

In some embodiments, the casing cutting tool 120 may cut through the lower casing collar 303*b* such that the collar seal is broken and becomes freed and advance upward in the wellbore 114 continuously cutting longitudinal cuts 306 until reaching upper casing collar 303*a* which may be cut by the casing cutting tool 120 such that the collar seal is broken and becomes freed, thereby allowing the casing string 116 and the corresponding cement 118 existing between lower casing collar 303*b* and upper casing collar 303*a* to dislodge from formation rock 302 and fall into rathole 128 therebelow. As will be appreciated by one of skill in the art, the speed at which the casing cutting tool 120 is advanced upward in the wellbore so as to dislodge casing string 116 and corresponding cement 118 in a single cutting motion (i.e., without stroking the casing cutting tool 120) may depend on a variety of factors. Such factors may include, for example, the depth of the casing string 116, the depth of the cement 118, the type of jetting nozzle(s) 208, the fluid disposed in jetting tool 206 for jetting through jetting nozzle(s) 208, the pressure of the fluid, the velocity of the fluid, and other parameters known to those of skill in the art.

In some embodiments, the casing cutting tool 120 may be stroked between lower casing collar 303*b* and upper casing collar 303*a* until satisfactorily deep longitudinal cuts 306 are made, without breaking the collar seal of either lower casing collar 303*b* or upper casing collar 303*a*. Thereafter, the lower casing collar 303*b* is cut with the casing cutting tool 120 such that the collar seal is broken and becomes freed and the casing cutting tool 120 is advanced up the wellbore 114 and cuts through upper casing collar 303*a* such that the collar seal is broken and becomes freed, thereby allowing the casing string 116 and corresponding cement 118 between lower casing collar 303*b* and upper casing collar 303*a* to dislodge from formation rock 302 and fall into rathole 128 therebelow.

According to the present disclosure, the casing cutting tool 120 may cut as it progresses downward through the wellbore 114, cutting first through the upper casing collar 303*a* such that the collar seal is broken and becomes freed and advance downward continuously cutting longitudinal cuts 306 until reaching lower casing collar 303*b* which may be cut by the casing cutting tool 120 such that the collar seal is broken and becomes freed, thereby allowing the casing string 116 and the corresponding cement 118 existing between upper casing collar 303*a* and lower casing collar 303*b* to dislodge from formation rock 302 and fall into rathole 128 therebelow. In other embodiments, the casing cutting tool 120 may be stroked between upper casing collar 303*a* and lower casing collar 303*b* until satisfactorily deep longitudinal cuts 306 are made, without breaking the collar seal of either upper casing collar 303*a* or lower casing collar 303*b*. Thereafter, the upper casing collar 303*a* is cut with the casing cutting tool 120 such that the collar seal is broken and becomes freed and the casing cutting tool 120 is downward in the wellbore 114 and cuts through lower casing collar 303*b* such that the collar seal is broken and becomes freed, thereby allowing the casing string 116 and corresponding cement 118 between upper casing collar 303*a* and lower casing collar 303*b* to dislodge from formation rock 302 and fall into rathole 128 therebelow.

In some embodiments, the casing cutting tool 120 may cut longitudinal cuts 306 as it progresses upward beginning at lower casing collar 303*b* toward upper casing collar 303*a*, without cutting either lower casing collar 303*b* or upper casing collar 303*a*, but instead cutting the casing string(s) 116 and cement 118 therebetween. That is, the casing cutting tool 120 avoids cutting lower casing collar 303*b* and upper casing collar 303*a*. It will be appreciated by one of skill in the art that any number of additional casing collars may be located between lower casing collar 303*b* and upper casing collar 303*a* and may be cut by casing cutting tool 120, while avoiding cutting lower casing collar 303*b* and upper casing collar 303*a*. Upon reaching upper casing collar 303*a* by the casing cutting tool 120 (without cutting it), the casing cutting tool 120 may be repositioned back to lower casing cutting collar 303*b* and arranged such that a plurality of detents 210 extending from retractable wedge(s) 204 (FIG. 2) are inserted or otherwise positioned into the longitudinal cuts 306. In some embodiments, the casing cutting tool 120 may cut deeper into the longitudinal cuts 306 as it is repositioned back to lower casing collar 303*b* the casing cutting tool 120 may cut as it is moved back to lower casing collar 303*b* or it may be repositioned to lower casing collar 303*b* without cutting). In other embodiments, multiple strokes of casing cutting tool 120 may be utilized to cut the casing string(s) 116, cement 118, and any casing collars between lower casing collar 303*b* and upper casing collar 303*a*. Once the casing cutting tool 120 is repositioned at lower casing collar 303*b*, it may be used to cut and free lower casing collar 303*b*. Thereafter, it may be repositioned to cut and free upper casing collar 303*a*. In some embodiments, the casing cutting tool 120 may make a first cut in lower casing collar 303*b*, then be repositioned to make a second cut in upper casing collar 303*a*, followed by repositioning agent to make a third cut in lower casing collar 303*b*. This staggered cutting between the lower casing collar 303*b* and upper casing collar 303*a* may be repeated multiple times until the collar seals of lower casing collar 303*b* and upper casing collar 303*a* are broken and become freed, thereby allowing the casing string(s) 116 and corresponding cement 118 between lower casing collar 303*b* and upper casing collar 303*a* to dislodge from formation rock 302 and fall into rathole 128 therebelow. In some embodiments, the staggered cutting of lower casing collar 303*b* and upper casing collar 303*a* may be repeated about 5 times, or about 6 times.

In some embodiments, the casing cutting tool 120 may cut longitudinal cuts 306 as it progresses upward beginning at lower casing collar 303*b* toward upper casing collar 303*a*, without cutting either lower casing collar 303*b* or upper casing collar 303*a*, but instead cutting the casing string(s) 116 and cement 118 therebetween. That is, the casing cutting tool 120 avoids cutting lower casing collar 303*b* and upper casing collar 303*a*. It will be appreciated by one of skill in the art that any number of additional casing collars may be located between lower casing collar 303*b* and upper casing collar 303*a* and may be cut by casing cutting tool 120, while avoiding cutting lower casing collar 303*b* and upper casing collar 303*a*. Upon reaching upper casing collar 303*a* by the casing cutting tool 120, the casing cutting tool 120 may cut and free upper casing collar 303*a*. Thereafter, it may be repositioned back to lower casing cutting collar 303*b* and arranged such that a plurality of detents 210 extending from retractable wedge(s) 204 (FIG. 2) are inserted or otherwise positioned into the longitudinal cuts 306 and used to cut and free lower casing collar 303*b*, thereby allowing the casing string(s) 116 and corresponding cement 118 between lower casing collar 303*b* and upper casing collar 303*a* to dislodge from formation rock 302 and fall into rathole 128 therebelow. In some embodiments, the casing cutting tool 120 may make a plurality of strokes to cut casing string(s) 116, cement 118, any casing collars therebetween, lower casing collar 303*b*, and upper casing collar 303*a*, without departing from the scope of the disclosure.

In some embodiments, the casing cutting tool 120 may cut longitudinal cuts 306 as it progresses downward beginning at upper casing collar 303*a* toward lower casing collar 303*b*, without cutting either upper casing collar 303*a* or lower casing collar 303*b*, but instead cutting the casing string(s) 116 and cement 118 therebetween. That is, the casing cutting tool 120 avoids cutting upper casing collar 303*a* and lower casing collar 303*b*. It will be appreciated by one of skill in the art that any number of additional casing collars may be located between upper casing collar 303*a* and lower casing collar 303*b* and may be cut by casing cutting tool 120, while avoiding cutting upper casing collar 303*a* and lower casing collar 303*b*. Upon reaching lower casing collar 303*b* by the casing cutting tool 120 (without cutting it), the casing cutting tool 120 may be repositioned back to upper casing cutting collar 303*a* and arranged such that a plurality of detents 210 extending from retractable wedge(s) 204 (FIG. 2) are inserted or otherwise positioned into the longitudinal cuts 306. In some embodiments, the casing cutting tool 120 may cut deeper into the longitudinal cuts 306 as it is repositioned back to upper casing collar 303*a* (i.e., the casing cutting tool 120 may cut as it is moved back to upper casing collar 303*a* or it may be repositioned to upper casing collar 303*a* without cutting). In other embodiments, multiple strokes of casing cutting tool 120 may be utilized to cut the casing string(s) 116, cement 118, and any casing collars between upper casing collar 303*a* and lower casing collar 303*b*. Once the casing cutting tool 120 is repositioned at upper casing collar 303*a*, it may be used to cut and free upper casing collar 303*a*. Thereafter, it may be repositioned to cut and free lower casing collar 303*b*. In some embodiments, the casing cutting tool 120 may make a first cut in upper casing collar 303*a*, then be repositioned to make a second cut in lower casing collar 303*b*, followed by repositioning agent to make a third cut in upper casing collar 303*a*. This staggered cutting between the upper casing collar 303*a* and lower casing collar 303*b* may be repeated multiple times until the collar seals of upper casing collar 303*a* and lower casing collar 303*b* are broken and become freed, thereby allowing the casing string(s) 116 and corresponding cement 118 between upper casing collar 303*a* and lower casing collar 303*b* to dislodge from formation rock 302 and fall into rathole 128 therebelow. In some embodiments, the staggered cutting of upper casing collar 303*a* and lower casing collar 303*b* may be repeated about 5 times, or about 6 times.

In some embodiments, the casing cutting tool 120 may cut longitudinal cuts 306 as it progresses downward beginning at upper casing collar 303*a* toward lower casing collar 303*b*, without cutting either upper casing collar 303*a* or lower casing collar 303*b*, but instead cutting the casing string(s) 116 and cement 118 therebetween. That is, the casing cutting tool 120 avoids cutting upper casing collar 303*a* and lower casing collar 303*b*. It will be appreciated by one of skill in the art that any number of additional casing collars may be located between upper casing collar 303*a* and lower casing collar 303*b* and may be cut by casing cutting tool 120, while avoiding cutting upper casing collar 303*a* and lower casing collar 303*b*. Upon reaching lower casing collar 303*b* by the casing cutting tool 120, the casing cutting tool 120 may cut and free lower casing collar 303*b*. Thereafter, it may be repositioned back to upper casing cutting collar 303*a* and arranged such that a plurality of detents 210 extending from retractable wedge(s) 204 (FIG. 2) are inserted or otherwise positioned into the longitudinal cuts 306 and used to cut and free upper casing collar 303*a*, thereby allowing the casing string(s) 116 and corresponding cement 118 between upper casing collar 303*a* and lower casing collar 303*b* to dislodge from formation rock 302 and fall into rathole 128 therebelow. In some embodiments, the casing cutting tool 120 may make a plurality of strokes to cut casing string(s) 116, cement 118, any casing collars therebetween, upper casing collar 303*a*, and lower casing collar 303*b*, without departing from the scope of the disclosure.

It will be appreciated that any number of casing collars may be cut in sequential order or in any random order between upper casing collar 303*a* and lower casing collar 303*b*, without departing from the scope of this disclosure. In some embodiments, only a portion of casing collars along the axial length 130 may be cut. In other embodiments, each casing collar along axial length 130 may be cut. Moreover, it will be appreciated that any number of casing collars may be cut in sequential order or in any random order between upper casing collar 303*a* and lower casing collar 303*b* beginning either at upper casing collar 303*a* or lower casing collar 303*b* and may be cut using a single stroke or multiple strokes the casing cutting tool 120 any number of times, without departing from the scope of this disclosure.

Still referring to FIG. 4A, the bridge plug 126 may be set within the wellbore 114 to generally seal the lower portions of the wellbore 114. As discussed above, this may be done prior to running in the casing cutting tool 120 or, alternatively, the casing cutting tool 120 may help facilitate the placement and setting of the bridge plug 126. In some embodiments, the bridge plug 126 may be set 100-200 feet below the area of the wellbore 114 that is to be cut or otherwise prepared, thereby forming the rathole 128 therebetween. As will be appreciated, however, the bridge plug 126 may be set at any distance desired below the area of the wellbore 114 that is to be cut. The resulting rathole 128 may be configured to be large enough to receive and contain all the debris and slats 310 (FIG. 3) that will fall therein as a result of the cutting operation of the casing cutting tool 120.

In FIG. 4B, the casing cutting tool 120 has completed making longitudinal cuts 306 (FIG. 3) along the predetermined axial length 130 in the wellbore 114 beginning at the middle portion of lower casing collar 303*b* and continuing upward to the middle portion of upper casing collar 303*a*. As the casing cutting tool 120 cuts, lower retractable wedge 204*b* and upper retractable wedge 204*a* insert into the longitudinal cuts 306 and prevent the casing cutting tool 120 from rotating and otherwise guide the casing cutting tool 120 as it cuts upwards toward upper casing collar 303*a*. The longitudinal cuts 306 made between the middle of the lower casing collar 303*b* and the middle of the upper casing collar 303*a* by casing cutting tool 120 cause multiple slats 310 (e.g., including pieces of both the casing string 116 and the cement 118) and other debris to fall into the rathole 128 therebelow and leave behind portions of upper casing collar 303*a* and lower casing collar 303*b* intact. In some embodiments, one or more transverse cuts 308 may also be made along the axial length 130. Once the slats 310 are removed, the face of the formation rock 302 becomes exposed.

To cut the slats 310, as described above, the casing cutting tool 120 may first be slowly passed in a single stroke between the middle of lower casing collar 303*b* and upper casing collar 303*a* or may be stroked up and/or down a plurality of times along the predetermined axial length 130 of the wellbore 114 in order to define the longitudinal cuts 306. Depending on the thickness or the number of layers of casing string 116 in the wellbore 114, and the thickness of the cement 118, the casing cutting tool 120 may have to be stroked multiple times in order to reach the formation rock 302. In some cases, the casing cutting tool 120 may be stroked between 2 and 10 times. In other cases, the casing cutting tool 120 may be stroked 8 times. The hydraulic pressure from the jets generated by the jetting nozzles 208 may serve to dislodge the cut slats 310 from the formation rock 302 such that they fall into the rathole 128.

Referring to FIG. 4C, once the casing cutting tool 120 has made all the planned longitudinal cuts 306 and optional transverse cuts 308, and the slats 310 have each fallen into the rathole 128, the exposed face of the formation rock 302 may be left across all or a portion of the predetermined axial length 130. In some embodiments, a camera (not shown), such as the one described above in association with the casing cutting tool 120, or the like may be used to inspect the face of the formation rock 302 to determine if the operation was successful. Thereafter, a solid cement plug 402 may be placed in the wellbore 114 in order to properly seal the wellbore 114 across the axial length 130. The bridge plug 126 prevents the cement plug 402 from extending downhole past that point. In some embodiments, the slats 310 may be removed from the wellbore 114 prior to placing the cement plug 402. In other embodiments, however, the slats 310 may be cemented into place within the wellbore 114 and otherwise form part of the cement plug 402.

In some embodiments, the cement plug 402 may be placed in the wellbore 114 with any wellbore cementing tool (not shown) known to those skilled in the art and conveyed therein using coiled tubing or the like. In other embodiments, however, the casing cutting tool 120 may be configured to place the cement plug 402 following its cutting operations. In such embodiments, the cement used to make the cement plug 402 may be conveyed via the conveyance 122 to the casing cutting tool 120 and the jetting tool 206. The jetting nozzles 208 may be configured to eject the cement from the jetting tool 206 across the predetermined axial length 130 of the wellbore 114, thereby sealing the exposed portions of the formation rock 302 and facilitating the setting of the cement plug 402.

As will be recognized by those skilled in the art, using the jetting tool 206 to place the cement plug 402 may prove advantageous. For instance, since cement in a cement slurry is also an abrasive fluid, during the final stages of cutting, a cement slurry may be pumped through the jetting tool 206 and used to cut the casing string 116 and the cement 118. After the last slats 310 drop into the rathole 128, the jetting tool 206, while still pumping cement through its nozzles 208, may be lowered within the wellbore 114 in order to wash the exposed formation rock 302 with cement slurry while simultaneously circulating the initial jetting fluid out of the jetting tool 206. In some cases, this cleanout procedure may result in a more robust cement plug 402.

As will be appreciated, by exposing the face of the formation rock 302, the cement from the cement plug 402 is able to directly contact the formation rock 302. As a result, the cement plug 402 will better seal the wellbore 114 such that no unwanted fluids may leak or otherwise effuse therefrom and traverse the wellbore 114 to the surrounding environment at the surface.

Embodiments disclosed herein include:

A. A method of removing a section of a wellbore, comprising: conveying a casing cutting tool into the wellbore on a conveyance, the wellbore being lined with at least one casing string having a lower casing collar and an upper casing collar being separated by a predetermined axial distance along the wellbore and secured in the wellbore by cement, and the casing cutting tool including a jetting tool having one or more jetting nozzles arranged thereon; stroking the casing cutting tool with the conveyance over the predetermined axial length while ejecting a fluid from the one or more jetting nozzles arranged thereon, thereby forming a plurality of longitudinal cuts through the at least one casing string and the cement between the lower casing collar and the upper casing collar, and through the lower casing collar and the upper casing collar; and dislodging one or more slats from the wellbore and thereby exposing formation rock along at least a portion of the predetermined axial length.

B. A system, comprising: a wellbore formed through one or more subterranean formations and being lined with at least one casing string having a lower casing collar and an upper casing collar being separated by a predetermined axial distance along the wellbore and secured in the wellbore by cement; and a casing cutting tool conveyable into the wellbore on a conveyance and including a jetting tool having one or more jetting nozzles arranged thereon, the jetting tool being configured to eject a fluid through the one or more jetting nozzles to form a plurality of longitudinal cuts through the at least one casing string and the cement between the lower casing collar and the upper casing collar, and through the lower casing collar and the upper casing collar, wherein one or more slats are defined in the wellbore as a result of the plurality of longitudinal cuts.

C. A casing cutting tool, comprising: a top mandrel operatively coupled to a conveyance; a first retractable wedge operatively coupled to the top mandrel; a jetting tool operatively coupled to the retractable wedge, the retractable wedge thereby interposing the top mandrel and the jetting tool, wherein the jetting tool has one or more jetting nozzles arranged thereon; and a bottom terminal operatively coupled to the jetting tool, the jetting tool thereby interposing the retractable wedge and the bottom terminal.

Each of embodiments A, B, and C may have one or more of the following additional elements in any combination:

Element 1: Wherein stroking the casing cutting tool with the conveyance over the predetermined axial length comprises stroking the casing cutting tool over the predetermined axial length multiple times.

Element 2: Wherein stroking the casing cutting tool with the conveyance over the predetermined axial length comprises stroking the casing cutting tool over the predetermined axial length multiple times beginning at the lower casing collar and ending at the upper casing collar.

Element 3: Wherein stroking the casing cutting tool with the conveyance over the predetermined axial length comprises stroking the casing cutting tool over the predetermined axial length multiple times beginning at the upper casing collar and ending at the lower casing collar.

Element 4: Wherein stroking the casing cutting tool with the conveyance over the predetermined axial length comprises rotating the casing cutting tool about its longitudinal axis at two or more axially offset locations along the predetermined axial length while ejecting the fluid from the one or more jetting nozzles and thereby forming a plurality of axially offset transverse cuts in the at least one casing string and the cement between the lower casing collar and the upper casing collar.

Element 5: Washing the formation rock with the fluid, wherein the fluid is an abrasive cutting solution.

Element 6: Wherein dislodging the one or more slats from the wellbore and thereby exposing the formation rock along at least a portion of the predetermined axial length comprises eroding an area behind each of the one or more slats with jet pressure generated by the one or more jetting nozzles.

Element 7: Receiving the one or more slats in a rathole defined in the wellbore below the predetermined axial length of the wellbore.

Element 8: Wherein a rathole is defined in the wellbore below the predetermined axial length of the wellbore, the rathole being configured to receive the one or more slats upon being dislodged from surrounding formation rock and thereby exposing the formation rock along at least a portion of the predetermined axial length, and wherein a bridge plug is arranged within the wellbore below the rathole.

Element 9: Wherein the jetting tool is further configured to eject the fluid through the one or more jetting nozzles to form a plurality of transverse cuts through the at least one casing string and cement between the lower casing collar and the upper casing collar, and through the lower casing collar and the upper casing collar.

Element 10: Wherein the one or more jetting nozzles are arranged about a circumference of the jetting tool in a single axial plane.

Element 11: Wherein the fluid is an abrasive cutting solution.

Element 12: Wherein the abrasive cutting solution is a cement slurry.

Element 13: Wherein jet pressure generated by the one or more jetting nozzles serves to dislodge the one or more slats from the surrounding formation rock.

Element 14: A second retractable wedge operatively coupled between the jetting tool and the bottom terminal.

Element 15: Wherein the retractable wedge is spring loaded.

Element 16: A casing collar locator arranged on the casing cutting tool, the casing collar locator being a two-way telemetry system allowing for communication between the casing collar locator and a surface detection device.

Element 17: A swivel head operatively coupled between the top mandrel and the first retractable wedge.

By way of non-limiting example, exemplary combinations applicable to A and B include: A with 1, 3, 10, and 16; B with 2, 8, and 13; and C with 9, 11, 15, and 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method of removing a section of a wellbore, comprising:

conveying a casing cutting tool into the wellbore on a conveyance, the wellbore being lined with at least one casing string having a lower casing collar and an upper casing collar being separated by a predetermined axial distance along the wellbore and secured in the wellbore by cement, and the casing cutting tool including a jetting tool having one or more jetting nozzles arranged thereon;

stroking the casing cutting tool with the conveyance over the predetermined axial length while ejecting a fluid from the one or more jetting nozzles arranged thereon, thereby forming a plurality of longitudinal cuts through the at least one casing string and the cement specifically spanning the distance between the lower casing collar and the upper casing collar, and through the lower casing collar and the upper casing collar; and dislodging one or more slats from the wellbore and thereby exposing formation rock along at least a portion of the predetermined axial length.

2. The method of claim 1, wherein stroking the casing cutting tool with the conveyance over the predetermined axial length comprises stroking the casing cutting tool over the predetermined axial length multiple times.

3. The method of claim 1, wherein stroking the casing cutting tool with the conveyance over the predetermined axial length comprises stroking the casing cutting tool over the predetermined axial length multiple times beginning at the lower casing collar and ending at the upper casing collar.

4. The method of claim 1, wherein stroking the casing cutting tool with the conveyance over the predetermined axial length comprises stroking the casing cutting tool over the predetermined axial length multiple times beginning at the upper casing collar and ending at the lower casing collar.

5. The method of claim 1, wherein stroking the casing cutting tool with the conveyance over the predetermined axial length comprises rotating the casing cutting tool about its longitudinal axis at two or more axially offset locations along the predetermined axial length while ejecting the fluid from the one or more jetting nozzles and thereby forming a plurality of axially offset transverse cuts in the at least one casing string and the cement between the lower casing collar and the upper casing collar.

6. The method of claim 1, further comprising washing the formation rock with the fluid, wherein the fluid is an abrasive cutting solution.

7. The method of claim 1, wherein dislodging the one or more slats from the wellbore and thereby exposing the formation rock along at least a portion of the predetermined axial length comprises eroding an area behind each of the one or more slats with jet pressure generated by the one or more jetting nozzles.

8. The method of claim 1, further comprising receiving the one or more slats in a rathole defined in the wellbore below the predetermined axial length of the wellbore.

9. The method of claim 1, wherein the plurality of longitudinal cuts formed by the one or more jetting nozzles have an angle in the range of about 10° to about 20°.

10. A system, comprising:

a wellbore formed through one or more subterranean formations and being lined with at least one casing string having a lower casing collar and an upper casing collar being separated by a predetermined axial distance along the wellbore and secured in the wellbore by cement; and a casing cutting tool conveyable into the wellbore on a conveyance and including a jetting tool having one or more jetting nozzles arranged thereon, the jetting tool being configured to eject a fluid through the one or more jetting nozzles to form a plurality of longitudinal cuts through the at least one casing string and the cement specifically spanning the distance between the lower casing collar and the upper casing collar, and through the lower casing collar and the upper casing collar, wherein one or more slats are defined in the wellbore as a result of the plurality of longitudinal cuts.

11. The system of claim 10, wherein a rathole is defined in the wellbore below the predetermined axial length of the wellbore, the rathole being configured to receive the one or more slats upon being dislodged from surrounding formation rock and thereby exposing the formation rock along at least a portion of the predetermined axial length, and wherein a bridge plug is arranged within the wellbore below the rathole.

12. The system of claim 10, wherein the jetting tool is further configured to eject the fluid through the one or more jetting nozzles to form a plurality of transverse cuts through the at least one casing string and cement between the lower casing collar and the upper casing collar, and through the lower casing collar and the upper casing collar.

13. The system of claim 10, wherein the one or more jetting nozzles are arranged about a circumference of the jetting tool in a single axial plane.

14. The system of claim 10, wherein the fluid is an abrasive cutting solution.

15. The system of claim 14, wherein the abrasive cutting solution is a cement slurry.

16. The system of claim 10, wherein jet pressure generated by the one or more jetting nozzles serves to dislodge the one or more slats from the surrounding formation rock.

17. The system of claim 10, wherein the plurality of longitudinal cuts formed by the one or more jetting nozzles have an angle in the range of about 10° to about 20°.

* * * * *